United States Patent [19]

Talaski et al.

[11] Patent Number: 5,002,467

[45] Date of Patent: Mar. 26, 1991

[54] IN-TANK FUEL PUMP MOUNT

[75] Inventors: Edward J. Talaski, Caro; Thomas M. Hoover, Reese, both of Mich.

[73] Assignee: Walbro Corporation, Cass City, Mich.

[21] Appl. No.: 312,259

[22] Filed: Feb. 17, 1989

[51] Int. Cl.[5] ..... F04B 35/04

[52] U.S. Cl. ..... 417/363; 417/423.15

[58] Field of Search ..... 417/360, 363, 371, 410, 417/423.3, 423.14, 423.15; 222/385; 248/611, 613, 618, 218.4

[56] References Cited

U.S. PATENT DOCUMENTS

| | | | |
|---|---|---|---|
| 2,108,734 | 2/1938 | Van Sciver | 417/363 |
| 3,143,284 | 8/1964 | Lindsjo et al. | 417/363 |
| 4,212,600 | 7/1980 | Otto et al. | 417/360 |
| 4,306,844 | 12/1981 | Otto et al. | 417/424 |
| 4,362,476 | 12/1982 | Kemmer et al. | 417/360 |
| 4,569,637 | 2/1986 | Tuckey | 417/410 |
| 4,768,925 | 9/1988 | Geupel | 415/219 R |
| 4,780,063 | 10/1988 | Tuckey | 417/360 |

FOREIGN PATENT DOCUMENTS 59-168256 9/1984 Japan .

*Primary Examiner*—Leonard E. Smith
*Assistant Examiner*—Eugene L. Szczecina, Jr.
*Attorney, Agent, or Firm*—Barnes, Kisselle, Raisch, Choate, Whittemore & Hulbert

[57] ABSTRACT

A mounting system for electric pumps used in automotive vehicles, especially those in which the pump is installed in the fuel tank. To reduce pump and pump motor vibrations and noise, which may be objectionable to passengers, the pump is mounted within a jacket enclosure carried in the vehicle fuel tank. A suspension for the pump within the jacket consists of identical mount rings of relatively soft flexible material which has internal and external relatively thin projections to contact the inner walls of the jacket on the outside of the ring and to contact the pump housing on the inside of the ring. Radial continuations of the projections establish the axial location of the pump within the jackets.

6 Claims, 1 Drawing Sheet

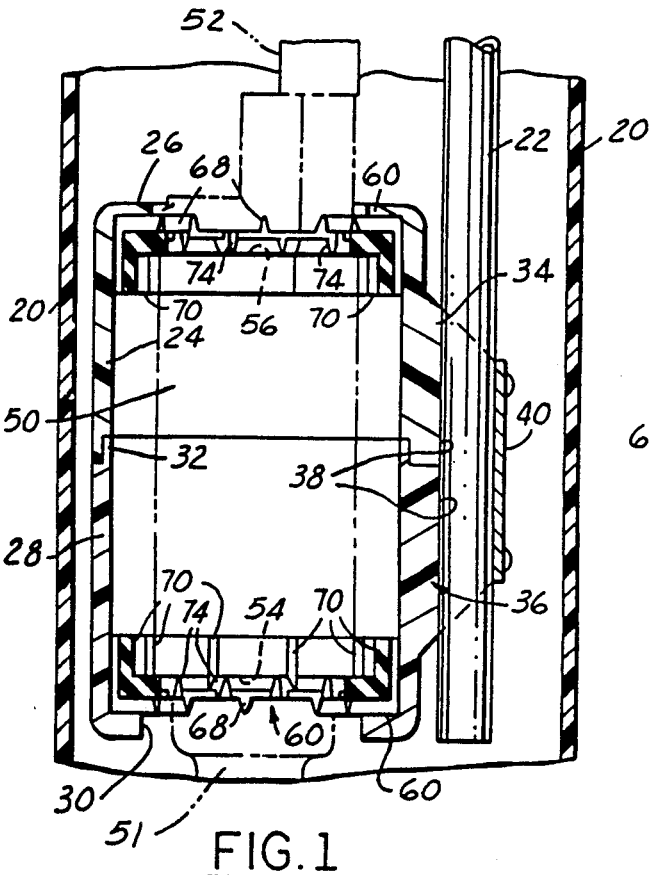
FIG. 1
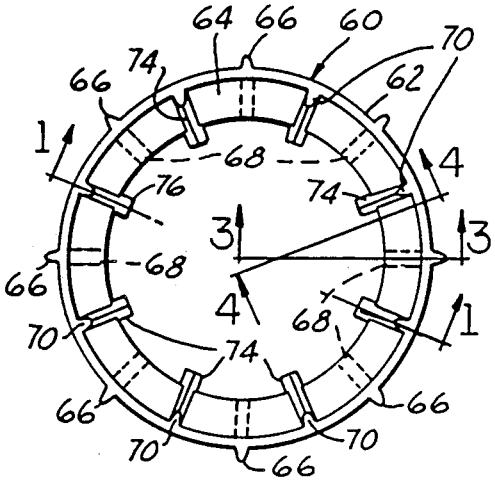
FIG. 2
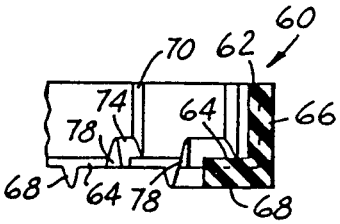
FIG. 3
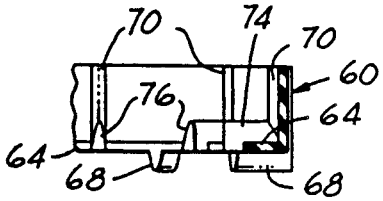
FIG. 4
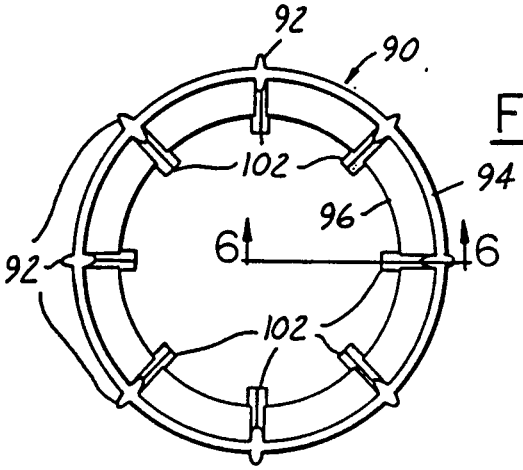
FIG. 5
FIG. 6
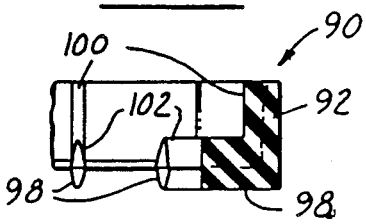

IN-TANK FUEL PUMP MOUNT

REFERENCE TO RELATED APPLICATION

Reference is made to copending application Ser. No. 284,996 filed Dec. 16, 1988 and assigned to a common assignee of this application.

FIELD OF INVENTION

The mounting of electric fuel pumps in automotive fuel tanks, or return flow or aspirator filled canisters in fuel tanks, in a manner to reduce transmission and noise to the passenger compartment of a vehicle.

BACKGROUND AND FEATURES OF THE INVENTION

Since the advent of fuel injection systems, it has become almost universal to utilize electric fuel pumps to furnish fuel to internal combustion engines of automotive vehicles. This system has supplanted the old system of drawing fuel from a tank with a vacuum system or a fuel pump driven in the engine compartment. However, since the fuel tank is usually mounted at the rear of a vehicle below the rear passenger compartment it has become an objective to minimize, as much as possible, the noise and vibration resulting from the rotating, positive-displacement pumps often used for this purpose. This effort has resulted in pump design to reduce flash-back noise. It has also resulted in efforts to mount the pump in such a way as to isolate noise and vibration.

In some instances a canister, that is, a small container is mounted in a fuel tank to receive fuel return from a pressure regulator in the pumping circuit or from an aspirator system. In this arrangement the pump is mounted in the canister, usually parallel to the axis of the canister, and draws fuel from the bottom of the canister to deliver to an outlet conduit leading to the engine fuel supply. One example of a noise reduction structure is found in a U.S. Pat. No. to Tuckey, 4,780,063 (1988) where a ribbed pliable jacket is used to surround and mount the pump. Another example is illustrated in the above-referenced copending application of Hoover and Talaski, Ser. No. 284,996, filed Dec. 16, 1988, where metal coil springs mount a pump housing within a jacket which is supported on a fuel return pipe projection within a fuel tank. This return pipe can be in a fuel tank canister or the pump may be mounted in a baffle system in the tank, or in the tank itself.

The present invention has also the objective of noise and vibration reduction with a specially designed grommet at each end of a surrounding jacket, the jacket being mounted to a flange within the tank, or to a baffle, or to a return pipe extending into a fuel tank or a canister. The grommet has radial projections which contact, respectively, the surrounding jacket and the pump housing itself. The contact, support, and isolation projections and the grommet walls on which the projections are mounted are resilient to absorb longitudinal and lateral pump vibrations as well as torsional pump vibrations to eliminate transmission to the enclosing canister or fuel tanks.

Objects and features of the invention will be apparent in the following specification and claims in which the principles of the invention are set forth together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as:

FIG. 1, a longitudinal sectional view on line 1—1 of FIG. 2 of the grommet support as mounted in a fuel tank canister.

FIG. 2, a plan view of the inner end of a locating grommet.

FIG. 3, a partial sectional view on line 3—3 of FIG. 2.

FIG. 4, a partial sectional view on line 4—4 of FIG. 2.

FIG. 5, a plan view of a modified grommet construction.

FIG. 6, a partial section on line 6—6 of FIG. 5.

DETAILED DESCRIPTION OF THE INVENTION AND THE MANNER AND PROCESS OF USING IT

With reference to the drawings, in FIG. 1, a tank canister is illustrated with walls 20. As one example of a pump mount in the fuel systems in which a canister is used, a pump within the canister delivers fuel to an outlet leading to a fuel rail and in the circuit is a pressure relief valve having an overflow outlet leading back to the canister. A return flow tube is mounted in a removable cover for supporting the canister within a fuel tank and this tube is cantilevered in that cover to depend into the canister. The above-referenced application, Ser. No. 284,996, filed Dec. 16, 1988, illustrates this mounting for the return tube. In FIG. 2, the tube 22 is the fuel return tube. Other structure within a fuel tank can also be utilized to support the pump such as a tank baffle or a flange within the tank.

A pump support housing or jacket is formed of a top cylindrical part 24 with an inturned flange 26, and a bottom part 28, with an inturned flange 30, joined to the upper part in a telescoping joint 32. Each part 24, 28 has a side projection 34, 36 with aligned openings 38 to receive the tube 22. A locking plate 40 is bolted to the projections 34, 36 to lock the top and bottom parts together and, at the same time, clamp the tube 22 securely. As indicated above, other means of mechanically mounting the pump jacket 24, 28 in a fuel tank can be utilized.

Shown in FIG. 1 is an electric pump body 50 with an inlet 51 and an outlet 52 and retaining shoulders 54 and 56 at respective ends. An isolation grommet 60 is disposed at each end of the two part jacket.

FIG. 2 illustrates a view of the resilient grommet 60 from the end which will be in contact with the pump body. The grommet consists of a basic ring 62 with an inwardly extending flange 64 at one end. Around the outside of the ring 62 are a plurality of radially outward rib projections 66, in this example, eight projections, having an axial length longer than the axial dimension of the wall (FIG. 3). These projections 66 turn inwardly over the flange 64 at 68 and extend to the inner rim of the flange making an L-shaped radial and axial projection with relatively thin circumferential dimension.

Between the projections 66 are a plurality of inwardly extending, L-shaped, radial, rib projections 70 on the inner wall of the ring 62 extending down to and radially over the flange 64 at 74 and radially inward at 76 of the flange a short distance and then axially at 78 along the inner edge of the flange.

To review this construction in general terms, both the outside and the inside of the flanged ring 62 have L-shaped projections extending over the flange 64 on each side respectively. These projections are preferably wedge shaped ensmalling from the base at the ring to the outer rounded nose surface. The durometer rating of the ring and projections is about 70 so that the projections will support the weight of the pump and still provide a resilient support. The material found to be most appropriate is fluoro-silicone or fluoro-elastomer since these are highly resistant to hydrocarbon fuels which may contain alcohol as well as oil distillates. Also, the design accommodates the use of materials that tend to swell in contact with fuels by retaining high flexibility in spite of the material swell.

As shown best in FIG. 1, the ring 60 slips over the ends of the pump body 50 in cup-like fashion. The inner nose surfaces of the vertical rib projections 70 contact the outer wall of the pump housing body 50 and the radial projections 74 contact the end surface of the pump body. Externally the outer ribs 66 contact the inner surface of the housing jacket 24, 28. The outer end projections 68 contact the annular inner surface of the flanges 26 and 30 of the jacket 24, 28.

Accordingly, the pump body is isolated from the supporting jacket entirely by the resilient ribs which have an inherent flexibility and resilience to absorb vibration and especially the torsional motion of the pump as it operates. In addition, the air space surrounding the pump body further isolates the pump noise.

In FIGS. 5 and 6, a modified isolation ring is illustrated. In this embodiment the inner and outer ribs are in the same radial plane rather than being staggered as in FIGS. 1 to 4. Outer vertical ribs 92 project outwardly from the basic ring body 94 which has the inturned flange 96. The ribs 92 turn radially inwardly over the flange 96 to provide the outer end contacts 98. Inner vertical ribs 100 merge with inner radial ribs 102.

This isolation ring operates in much the same manner as that depicted and described in FIG. 1 but would have less flexibility along the pump axis because of the same circumferential placement of the inner and outer ribs. However, this design would retain the high flexibility relative to fuel pump torsional movement.

It is important that it be recognized that the described ring design has two functions relative to vibrational absorption. The low rate normal vibrational movement of the pump is absorbed by the deflection of the rib projections and the inherent motion of the walls on which the ribs are mounted. This low rate absorption is important in the handling of lateral, axial and torsional motion of the pump body in the surrounding jacket. Higher accelerations of the vibrations or motion caused by exceptional load or road shocks may collapse the ribs and be absorbed by the resilience of the base material of the ring itself. This will afford a higher rate of resistance to the high load shocks. Thus, it is desirable that the base ring and the rib projections are both resilient in nature.

What is claimed is:

1. In a pump mount for a fuel system for passenger vehicles wherein an electric fuel pump is utilized to move fuel from a fuel tank to a fuel distribution device, an improvement to reduce noise emission and vibration which comprises:

(a) a fuel pump having a generally cylindrical casing with an outer cylindrical wall and an end wall at each end of the casing, (b) an open-ended enclosure surrounding said pump having walls spaced from said pump casing and an inturned flange at each end, (c) means to mount said enclosure in a fuel tank, and (d) resilient means at each end of said pump casing bearing against the interior of said enclosure to resiliently float said pump within said enclosure, said resilient means comprising a ring and an integral inturned flange formed of flexible resilient material to overlie a portion of the cylindrical wall of the casing and an outer annular portion of an end wall in cup-like fashion, the outer and inner surfaces of said ring and said integral flange having formed thereon circumferentially spaced, narrow ribs to contact the cylindrical wall and end wall of the pump on the inner side and to contact a wall of the enclosure and the inturned flange of the enclosure on the outer side to space the ring and integral flange from the enclosure and the pump casing, whereby the resilience of the ribs and ring absorbs lateral, axial and torsional motion of the pump, and higher shock loads are absorbed by the higher resilience of the base ring itself.

2. A combination as defined in claim 1 in which said ribs on the outer side of said ring and said integral flange are circumferentially spaced from said ribs on the inner side of said ring and integral flange.

3. A combination as defined in claim 1 in which said ring is formed of a fluoro-elastomer or fluoro-silicone material.

4. A combination as defined in claim 1 in which said ribs are formed in cross-section to have an ensmalling tapering shape from a base portion on the ring and integral flange to a contacting nose portion.

5. A combination as defined in claim 1 in which said ribs on the interior and the exterior of said ring and integral flange are L-shaped having one leg integral with a wall of said ring and a second leg extending radially along said integral flange.

6. A pump mount as defined in claim 5 in which the inner L-shaped rib has an axial return portion along the inner edge of the flange.

* * * * *